US012305509B2

(12) United States Patent
Sonderegger

(10) Patent No.: US 12,305,509 B2
(45) Date of Patent: May 20, 2025

(54) WORK MACHINE WITH LEADER

(71) Applicant: Liebherr-Werk Nenzing GmbH, Nenzing (AT)

(72) Inventor: Michael Sonderegger, Tschagguns (AT)

(73) Assignee: LIEBHERR-WERK NENZING GMBH, Nenzing (AT)

( * ) Notice: Subject to any disclaimer, the term of this patent is extended or adjusted under 35 U.S.C. 154(b) by 75 days.

(21) Appl. No.: 18/361,623

(22) Filed: Jul. 28, 2023

(65) Prior Publication Data

US 2024/0035340 A1 Feb. 1, 2024

(30) Foreign Application Priority Data

Jul. 29, 2022 (DE) ..... 20 2022 104 322.1

(51) Int. Cl.
*E21B 7/02* (2006.01)
*E02F 5/20* (2006.01)
*E21B 7/20* (2006.01)

(52) U.S. Cl.
CPC ..... *E21B 7/023* (2013.01); *E02F 5/20* (2013.01); *E21B 7/20* (2013.01)

(58) Field of Classification Search
CPC ..... E21B 7/02; E21B 7/023
See application file for complete search history.

(56) References Cited

U.S. PATENT DOCUMENTS

2007/0278013 A1* 12/2007 Poeckl ..... E21B 7/02 175/203
2015/0211206 A1* 7/2015 Otto ..... E21B 7/022 173/184
2021/0277720 A1* 9/2021 Watson ..... E21B 7/021

FOREIGN PATENT DOCUMENTS

| | | | |
|---|---|---|---|
| DE | 3610814 | A1 | 10/1987 |
| DE | 4436264 | C1 | 11/1995 |
| DE | 19520129 | A1 | 12/1996 |
| EP | 0745528 | A2 | 12/1996 |
| JP | S584025 | A | 1/1983 |

* cited by examiner

*Primary Examiner* — Kristyn A Hall
(74) *Attorney, Agent, or Firm* — McCoy Russell LLP

(57) ABSTRACT

The disclosure relates to a work machine comprising a mobile undercarriage, an upper carriage, a leader mounted on the upper carriage, and an attachment, wherein the leader is pivotably mounted on the upper carriage by means of a leader kinematic system and wherein the removable attachment can be mounted in an operating position on a front side of the leader facing away from the upper carriage. According to the disclosure, the removable attachment can be removed from the front side of the leader and the leader comprises receiving means via which the removable attachment can be mounted for transport on a rear side of the leader facing the upper carriage or laterally on the leader in a transport position.

11 Claims, 1 Drawing Sheet

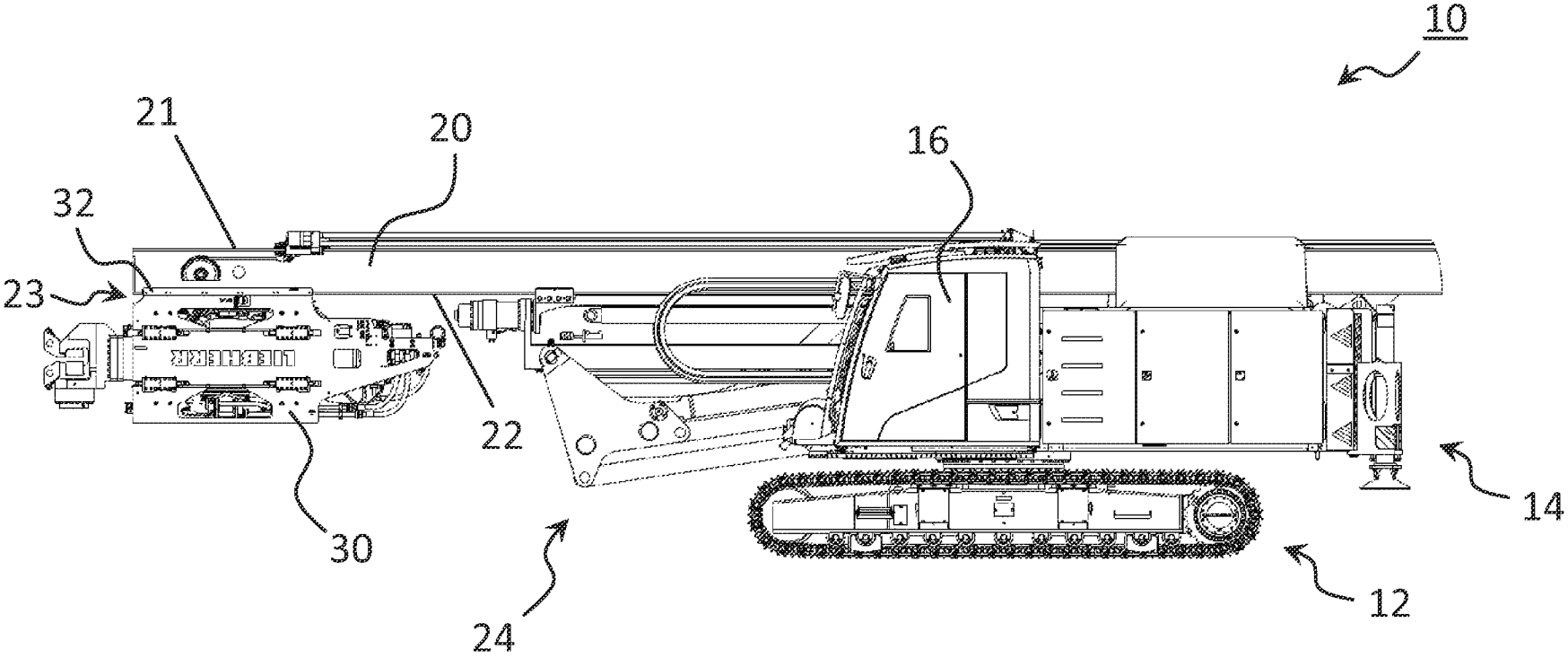
10
14
12
16
24
22
20
30
21
32
23

WORK MACHINE WITH LEADER

CROSS REFERENCE TO RELATED APPLICATION

The present application claims priority to German Patent Application No. 20 2022 104 322.1 filed on Jul. 29, 2022. The entire contents of the above-listed application are hereby incorporated by reference for all purposes.

TECHNICAL FIELD

The present disclosure relates to a work machine, in particular a mobile rotary drilling machine, pile driving work machine or drilling work machine, a leader for such a work machine, and a set composed of a leader and a removable attachment.

BACKGROUND

Many work machines comprise a mast or leader in order to be able to mount equipment on it and typically move it along the leader. Examples from the field of foundation engineering are rotary drilling rigs with a drill drive that can be moved along the leader or pile driving rigs with a vibrator or hydraulic hammer that can be moved along the leader. This equipment is often configured as removable attachments that can be removed from the leader for transport, for example. In addition, applications are known in which these removable attachments can be mounted not directly, but on a slide mounted on the leader (e.g. feed slide in a rotary drilling rig).

In many cases, the removable attachment is removed from the leader for transport and transported separately. This reduces the transport dimensions of the basic unit with leader, but at the same time increases the transport effort and associated costs.

In addition, solutions are known in which the removable attachment remains on the leader for transport. However, since the removable attachments on such work machines are mounted on the front side of the leader and the leader is usually pivoted backward into the transport position so that the front side of the leader faces upward, the transport dimensions, in particular the transport height, are increased because the leader is mounted on top of the leader in the transport position. In addition, such a solution is not possible with every work machine due to the respective leader kinematic system.

SUMMARY

The present disclosure is based on the object of enabling simple and inexpensive transport of machines of the same type. In particular, it should be possible to transport the leader and removable attachment together without having to accept a significant increase in the transport dimensions.

According to the disclosure, this object is achieved by a work machine having features as described herein.

Accordingly, a work machine is proposed, in particular a mobile rotary drilling, pile-driving or drilling rig, which comprises a mobile undercarriage, an upper carriage mounted in particular rotatably on the undercarriage, a leader mounted on the upper carriage, and a removable attachment. The leader is pivotably mounted on the upper carriage by means of a leader kinematic system so that it can be moved between an operating position with, for example (but not necessarily or exclusively), vertical orientation and a transport position with, for example (but not necessarily or exclusively), horizontal orientation. The removable attachment can be mounted in an operating position on a front side of the leader facing away from the upper carriage, i.e. in operation the removable attachment is located on the front side of the leader.

According to the disclosure, the removable attachment can be removed from the front side of the leader, for example, in order to move the removable attachment into a transport position or, if necessary, to be able to switch between different removable attachments. According to the disclosure, the leader comprises receiving means via which the removable attachment can be mounted for transport on a rear side of the leader facing the upper carriage or laterally on the leader in a transport position. In other words, the removable attachment can be removed from the operating position at the front side of the leader and mounted for transport in a transport position at the rear of the leader or at the side of the leader, wherein the leader provides suitable receiving means for this purpose.

Preferably, the removable attachment is located in the transport position at the rear of the leader in the area between the leader and the ground, as there is typically sufficient space available here and the transport dimensions are not increased. In addition, the leader is preferably located laterally offset next to a driver's cab of the upper carriage, so that a transport position of the removable attachment located below the leader in the transport position at its rear does not impair the driver's visibility. This is particularly relevant in cases where the work machine is not mounted on a transport vehicle but travels independently with the removable attachment in the transport position. In addition, this results in stable mounting of the removable attachment on the rear of the leader.

This means that the removable attachment can remain on the leader or on the basic unit without increasing or significantly increasing the transport dimensions. This means that the removable attachment does not have to be transported separately, which reduces the transport effort as well as costs.

In principle, it is conceivable that the same mounting means are used both for mounting the removable attachment on the front side of the leader (operating position) and for mounting it on the rear side of the leader (transport position). For example, symmetrical guide rails could be provided on the side of the leader, with the removable attachment (or a slide carrying the removable attachment) partially embracing the leader and being movably mounted on the guide rails. In this case, the removable attachment would have to be disconnected from the guide rails, positioned at the back of the leader, and reconnected to the side guide rails. In addition to this, further connections, e.g. bolt connections, could be provided to immovably fix the removable attachment in the transport position, since the removable attachment should in particular not be movable in the transport position.

It is also possible to have an arrangement in which the removable attachment (or a slide carrying it) can be fastened to the front side of the leader in the operating position via first mounting means and to the rear of the leader in the transport position via second mounting means. In this case, different mounting means are provided on the leader for mounting on the front side and on the rear side of the leader. The first mounting means can be or comprise guide rails.

The removable attachment comprises corresponding connecting means for connection to the receiving means. In the embodiment with first and second mounting means, either the same connecting means may be connectable to both the first and second mounting means. Alternatively, the removable attachment (or a carriage supporting the removable attachment) could also comprise first connecting means for connection to the first receiving means and second connecting means for connection to the second receiving means.

When the terms "bottom" or "top" are used, it is assumed that the work machine is standing on a horizontal, level surface.

In a possible embodiment, provision is made for that the leader comprises a leader guide on which the removable attachment can be displaceably mounted, in particular along a longitudinal axis of the leader. The removable attachment can thus be moved via the leader guide, in particular along the leader. Preferably, the leader guide comprises at least one guide rail extending parallel to the longitudinal axis of the leader, which can be arranged at the front side of the leader or laterally on the leader. Preferably, the removable attachment (or, if it is mounted on the leader via an attachment slide, the corresponding slide) comprises guide rail receptacles that cooperate with the guide rails of the leader guide and fix the removable attachment in particular perpendicular to the leader longitudinal axis.

The drive for the movement of the removable attachment along the leader can be effected in a manner known in principle from the prior art by hydraulic cylinder, feed cable or via another drive.

In another possible embodiment, the leader kinematic system is configured to pivot the leader in a vertical pivot plane relative to the upper carriage. This allows the leader to be pivoted between the operating position and the transport position. Preferably, one or more hydraulic pivot cylinders are provided to pivot the leader. The leader kinematic system can be configured in such a way that it also allows pivoting movements of the leader out of the said pivoting plane, i.e. lateral tilting. For this purpose, for example, two hydraulic cylinders can be provided, the extension length ratio of which enables such a pivot movement of the leader.

In the transport position, the leader is oriented in particular horizontally or substantially horizontally (i.e., with a slight inclination, for example, downward toward the front) so that the front side of the leader faces upward. In the operating position, the leader can preferably assume several positions, for example a vertical position as well as positions tilted with respect thereto within the pivoting plane or laterally with respect thereto. All these positions of the leader can be referred to as the operating position. This enables, for example, inclined drilling or the inclined insertion of sheet piles via a vertical vibrator.

In another possible embodiment, the removable attachment is arranged in the transport position at the rear of the leader between the leader and the ground and preferably in front of the upper carriage in the direction of travel. This makes optimum use of the available space without increasing the transport dimensions.

In another possible embodiment, the receiving means are arranged at an end region of the leader. In particular, the receiving means are located in the area of that end of the leader which forms the lower end of the leader in the case of a vertically erected leader. If the leader is tilted backwards into the transport position, said end with the receiving means is therefore located in particular in front of the upper carriage in the direction of travel, i.e. it projects forwards beyond the upper carriage.

In another possible embodiment, provision is made for that the receiving means are configured to immovably fix the removable attachment to the leader in the transport position, the receiving means preferably comprising bolt receptacles for establishing a bolt connection. This prevents the removable attachment from moving unintentionally during transport. Optionally, an additional locking mechanism can be provided to lock the removable attachment in the transport position. This can be manually or automatically actuated.

In a further possible embodiment, provision is made for that the receiving means are arranged at the rear and/or laterally on the leader. In particular, it is conceivable that the receiving means or part of the receiving means are located on the side of the leader, but the removable attachment is still arranged on the rear side of the leader in the transport position.

In a further possible embodiment, provision is made for that the leader is configured to be divisible and/or foldable and that the receiving means are located on a base part of the leader that is permanently connected to the leader kinematic system. As a result, the present disclosure can also be combined with a foldable and/or separable leader, such as is known in the prior art. A foldable leader may comprise two or more leader parts which are pivotable or foldable relative to each other, for example by means of hydraulic actuators. The base part permanently connected to the leader can be rigidly or foldably connected to the leader kinematic system and/or another leader part.

In another possible embodiment, the removable attachment is mountable on the front side of the leader via an attachment slide, and the removable attachment and the attachment slide each comprise connecting means for establishing a detachable connection between the removable attachment and the attachment slide. The attachment slide may be permanently or releasably connected to the leader. Preferably, the connecting means for releasably connecting the removable attachment and the attachment slide comprise bolt receptacles for establishing a bolt connection and/or suspension elements for establishing a suspension connection. A combination of bolt and suspension connection elements can also be provided, for example, in order to first suspend the removable attachment in the attachment slide for pre-positioning and then to bolt it and thereby finally fix it to the slide.

In a further possible embodiment, provision is made for that the attachment slide is mounted on the leader so as to be displaceable, in particular displaceable along a longitudinal axis of the leader via a leader guide. The leader guide may comprise one or more guide rails, as explained above, with the attachment slide preferably comprising corresponding rail receptacles.

The attachment slide can be a feed slide which can be moved, for example, by means of one or more hydraulic cylinders and/or a feed cable and can apply a downward feed force (or in the direction of the drilling tool) for drilling, for example.

In general, it is conceivable that the removable attachment comprises a work slide to which the actual attachment is attached. This work slide may comprise the mentioned connecting means for connection to the attachment slide mounted on the leader.

In another possible embodiment, provision is made for that the removable attachment can be directly connected to the receiving means of the leader. In this embodiment, the attachment slide remains at the front side of the leader, while the removable attachment is removed from the attachment slide and mounted at the rear side of the leader in the transport position. In this case, the mounting means could be analogous to the connecting means of the attachment slide, so that the removable attachment is mounted in the transport position in the same way and the same connecting means of the removable attachment can be used for this as for the connection of the removable attachment to the attachment slide.

Alternatively or additionally, the work machine, i.e. in particular leader and attachment slide, can be configured in such a way that the removable attachment together with the attachment slide can be removed from the leader and mounted at the rear of the leader in the transport position. In this case, the attachment slide can be connected to the mounting means of the leader. To move the removable attachment to the transport position, the removable attachment does not have to be separated from the attachment slide.

In another possible embodiment, provision is made for that the removable attachment comprises a drill drive, for example, a rotary drill drive for kelly drilling or a drill drive for down-the-hole hammer drilling, a double-headed drill drive, a hydraulic hammer or a vibrator, in particular a high-angle vibrator or belt vibrator.

The working equipment may be a construction machine for vibrating with high angle vibrator or belt vibrator, for hammering with hydraulic hammer, for wet mixing, for milling mixing, for down-the-hole hammer drilling, for kelly drilling (ordinary or low head), for double head drilling, for continuous flight auger drilling or for full displacement drilling.

The disclosure further relates to a leader for a work machine according to the disclosure. With regard to the features, advantages and possible embodiments of the leader according to the disclosure, the above explanations apply analogously, so that a repetitive description is dispensed with. The leader is connectable to a corresponding basic work machine, the basic work machine preferably comprising a mobile undercarriage and an upper carriage mounted thereon.

The disclosure further relates to a set composed of a leader according to the disclosure and an attachment which can be mounted in an operating position at the front side of the leader and in a transport position via receiving means at the rear of the leader. The advantages and features specified above in connection with the leader and the removable attachment result here as well. In particular, the removable attachment can be configured according to one of the embodiments specified above.

BRIEF DESCRIPTION OF THE FIGURE

Further features, details and advantages of the disclosure result from the preferred exemplary embodiment explained below with reference to the single FIGURE.

FIG. 1 shows a side view of a preferred exemplary embodiment of the work machine 10 according to the disclosure. The embodiment discussed here is a work machine 10 with a removable attachment tool 30 configured as a vibrator, more precisely as an edgewise vibrator, although of course any other attachment tool can also be used.

DETAILED DESCRIPTION

The work machine 10 comprises a base work machine with a mobile undercarriage 12, which in this embodiment comprises a crawler chassis. An upper carriage 14 is mounted on the undercarriage 12 in a manner rotatable about a vertical axis. The upper carriage 14 comprises an operator's cab 16 and a means for supporting the work machine (shown in the FIGURE at the rear of the upper carriage 14).

A leader 20 is connected to the upper carriage 14 via a leader kinematic system 24. The leader kinematic system 24, which comprises in particular one or more hydraulic cylinders and coupling elements, can be used to move the leader 20 between a transport position shown in FIG. 1, in which the leader 20 is mounted essentially horizontally, and an operating position. The operating position comprises, in particular, a vertical orientation of the leader 20, but may also include any inclined positions of the leader 20 made possible by the leader kinematic system 24. As a result, the pile-driving material, which can be gripped by a pincer of the vibrator 30, can be introduced into the subsoil not only vertically, but also at a certain angle to the vertical.

The leader 20 has a front face 21 that faces away from the upper carriage 14 and faces upward in the transport position as seen in FIG. 1.

The work machine comprises a removable attachment 30, in the present case in the form of an upright vibrator. In working operation, the removable attachment 30 is located in an operating position at the front side 21 of the leader 20 and can be moved along the leader 20, in particular via a movement mechanism not shown in FIG. 1. In particular, a downwardly directed force (in the operating position of the leader 20) can be applied to the vibrator 30 via the movement mechanism to assist in vibrating material into the ground.

In the operating position, the vibrator 30 can be mounted on the leader 20 either directly or via an attachment slide. FIG. 1 shows an embodiment without such a slide. However, the following explanations apply equally to an embodiment with an attachment slide. In this case, the vibrator 30 comprises first connecting means for connection to the leader 20.

The leader 20 preferably comprises guide rails on which the vibrator 30 is mounted in the operating position via corresponding guide rail receptacles 32. The guide rail receptacles 32 may constitute or comprise said first connecting means. Any position of the vibrator 30 on the front side 21 of the leader 20 along the longitudinal axis of the leader 20 may be considered as an operating position.

FIG. 1 shows the transport position of the work machine 10, in which the leader 20 is folded back over the leader kinematic system 24 and the lower end of the leader 20 extends forward beyond the upper carriage 14. In this position, the work machine 10 can be transported, for example on a transport vehicle (not shown). If the vibrator 30 were to remain in its operating position at the front side 21 of the leader 20, it would be positioned above the leader 20 in FIG. 1 and would significantly increase the transport height of the work machine 10.

For this reason, the disclosure provides a means for removing the vibrator 30 from the front side 21 of the leader 20 and mounting or storing it in a transport position spatially separated from the operating position in order to save space. In the exemplary embodiment shown here, the transport position of the vibrator 30 is on the rear side 22 of the leader 20 (which is opposite the leader front side 21), i.e. the vibrator 30 is arranged in the transport position on the leader rear side 22 between the leader 20 and the floor. This allows the vibrator 30 to be transported together with the leader 20 and the base unit without increasing the transport dimensions. By mounting the vibrator 30 on the leader rear 22, the operator also has a clear view to the front from the operator's cab 16, so that the work machine 10 can also be moved independently.

In order to support the vibrator 30 on the leader rear 22, the leader 20 comprises corresponding receiving means 23, which are concealed by the vibrator 30 in FIG. 1. The receiving means 23 can be located on the leader rear side 22.

The vibrator 30 may either comprise its own (second) connecting means for connection to the receiving means 23 of the leader 20. Alternatively or additionally, the first connecting means (represented in FIG. 1 by the guide rail receptacles 32) of the vibrator 30 can be used for connection to the receiving means 23 of the leader 20.

FIG. 1 is drawn to scale, although other relative positioning and relative dimensions may be used, if desired.

The invention claimed is:

1. Work machine, comprising a mobile undercarriage, an upper carriage, a leader mounted on the upper carriage, and a removable attachment, wherein the leader is pivotably mounted on the upper carriage by means of a leader kinematic system and wherein the removable attachment can be mounted in an operating position on a front side of the leader facing away from the upper carriage, wherein the removable attachment is detachable from the front side of the leader and the leader comprises receiving means by which the removable attachment can be mounted for transport on a rear side of the leader facing the upper carriage or laterally on the leader in a transport position; and the removable attachment is arranged in the transport position at the rear of the leader between the leader and the ground and in front of the upper carriage in a direction of travel.

2. Work machine according to claim 1, wherein the leader comprises a leader guide on which the removable attachment is displaceably mountable, including displaceably along a longitudinal axis of the leader, wherein the leader guide comprises at least one guide rail extending parallel to the longitudinal axis of the leader, which guide rail is arranged on the front side of the leader or laterally on the leader.

3. Work machine according to claim 1, wherein the leader kinematic system is configured to pivot the leader in a vertical pivoting plane relative to the upper carriage, including via one or more hydraulic pivoting cylinders, wherein the leader is oriented horizontally or substantially horizontally in the transport position and the front side of the leader faces upwards.

4. Work machine according to claim 1, wherein the receiving means are arranged at an end region of the leader, wherein the end region is located at an end which forms the lower end of the leader in the case of a vertically erected leader.

5. Work machine according to claim 1, wherein the receiving means are configured to immovably fix the removable attachment to the leader in the transport position, wherein the receiving means comprise bolt receptacles for establishing a bolt connection.

6. Work machine according to claim 1, wherein the receiving means are arranged on the rear side and/or laterally on the leader.

7. Work machine according to claim 1, wherein the leader is configured to be divisible and/or foldable and the receiving means are located on a base part of the leader that is permanently connected to the leader kinematic system.

8. Work machine according to claim 1, wherein the removable attachment is mountable on the front side of the leader via an attachment slide, and the removable attachment and the attachment slide each comprise connecting means for producing a releasable connection between the removable attachment and the attachment slide, wherein the connecting means comprise bolt receptacles for producing a bolt connection and/or suspension elements for producing a suspension connection.

9. Work machine according to claim 8, wherein the attachment slide is mounted on the leader so as to be displaceable, including displaceable along a longitudinal axis of the leader via a leader guide.

10. Work machine according to claim 8, wherein the removable attachment can be connected directly and/or via the attachment slide to the receiving means of the leader.

11. Work machine according to claim 1, wherein the work machine is one of a mobile rotary drilling, pile driving, or drilling work machine.

* * * * *